US006752458B1

(12) United States Patent
Rivera

(10) Patent No.: US 6,752,458 B1
(45) Date of Patent: Jun. 22, 2004

(54) ROCKING CHAIR

(75) Inventor: Richard Rivera, Garden Grove, CA (US)

(73) Assignee: Tropitone Furniture Co., Inc., Irvine, CA (US)

( * ) Notice: Subject to any disclaimer, the term of this patent is extended or adjusted under 35 U.S.C. 154(b) by 16 days.

(21) Appl. No.: 10/319,343

(22) Filed: Dec. 13, 2002

(51) Int. Cl.[7] ..... A47C 3/02
(52) U.S. Cl. ..... 297/258.1; 267/158
(58) Field of Search ..... 297/344.1, 325, 297/258.1, 259.1, 259.4, 302.1, 302.3; 267/158, 160, 164; 248/628; D6/344; 472/103

(56) References Cited

U.S. PATENT DOCUMENTS

| | | | | |
|---|---|---|---|---|
| 2,302,950 | A | | 1/1942 | Parsons |
| 2,283,755 | A | * | 5/1942 | Mies |
| 2,313,559 | A | * | 3/1943 | Larsen et al. |
| 2,689,464 | A | * | 9/1954 | Wurtz |
| 3,297,360 | A | * | 1/1967 | Holmstrom |
| 3,337,265 | A | * | 8/1967 | Benzing |
| 3,462,113 | A | * | 8/1969 | MacLeod |
| 3,740,792 | A | * | 6/1973 | Werner |
| 4,119,343 | A | | 10/1978 | Pentzien |
| 4,183,494 | A | * | 1/1980 | Cleveland |
| 4,340,250 | A | | 7/1982 | Ward |
| 4,383,714 | A | | 5/1983 | Ishida |
| D290,068 | S | | 6/1987 | Vanderminden |
| D291,846 | S | | 9/1987 | Conn |
| D299,986 | S | | 2/1989 | Doughty |
| D300,090 | S | | 3/1989 | Frinier |
| 4,971,394 | A | | 11/1990 | Vanderminden |
| 5,039,164 | A | | 8/1991 | Gibbs |
| 5,217,198 | A | * | 6/1993 | Samarov et al. |
| 5,599,064 | A | | 2/1997 | Vanderminden, Sr. |
| D415,363 | S | | 10/1999 | Rehmert et al. |

* cited by examiner

*Primary Examiner*—Milton Nelson, Jr.
(74) *Attorney, Agent, or Firm*—Knobbe, Martens, Olson & Bear LLP

(57) ABSTRACT

A rocking chair comprises a base portion and a seat portion and includes a pair of C-springs for coupling the base portion to the seat portion. The C-springs flex to provide the seat portion with a desirably smooth and soft rocking motion while providing excellent structural integrity. Each C-spring has a contoured cross-sectional profile that provides a spring stiffness adapted to provide a smooth and comfortable rocking motion for a wide variety of body weight. The contoured cross-sectional profile also provides a high torsional resistance for minimizing lateral rocking movement of the seat portion.

26 Claims, 6 Drawing Sheets

ROCKING CHAIR

BACKGROUND OF THE INVENTION

1. Field of the Invention

This invention relates to chair structures, and more particularly, to an improved chair structure that is well-suited for outdoor use and provides swiveling and rocking motions.

2. Description of the Related Art

Outdoor furniture can be found in a wide variety of locations, such as, for example, outdoor restaurants, patios, and backyards. Outdoor furniture takes a wide variety of different forms but is typically manufactured from plastic and/or metal components to withstand the damaging effects of exposure to sun and moisture.

A common piece of outdoor furniture is the outdoor chair. Most outdoor chairs are constructed as rigid, unitary structures. However, for comfort and convenience, some outdoor chairs have a seat portion that is adapted to swivel relative to a base portion while other chairs provide the user with the ability to rock forward and backward. Still other chairs provide both swiveling and rocking motions.

In order to provide a rocking motion, some chairs include a pair of curved rails mounted beneath a seat portion of the chair. The curved rails contact the ground and are shaped to allow the user to rock back and forth with a smooth and comfortable motion. However, rocking chairs having curved rails are typically quite large and cumbersome and do not cooperate well with a table. Furthermore, curved rails are adapted for use on a relatively flat and smooth surface. The ground in an outdoor environment is often rough and uneven and therefore curved rail rocking chairs are not well-suited for outdoor use. In addition, curved rail rocking chairs are usually constructed of wood, are quite heavy and can be difficult to transport.

Rocking chairs constructed with a base portion that is fixed relative to the ground are better suited for use in an outdoor environment. To provide a rocking motion, a fixed-base chair structure includes a flexible coupling member that is located between the base portion and the seat portion. Fixed-base rocking chairs are typically less bulky than curved rail rocking chairs. As a result, fixed-base rocking chairs are more compact and may be used with a table in a more practical fashion. In addition, they do not require a smooth, flat surface.

A flexible coupling member used with a fixed-based rocking chair may take a variety of different forms. However, in each case, the flexible coupling member allows movement of the seat portion relative to the base portion. Flexible coupling members of this type are typically constructed of a steel alloy. Over the years, steel has been a preferred material for flexible coupling members because steel provides a desirably smooth and soft rocking motion while, at the same time, providing sufficient strength to accommodate a wide variety of body weights. In addition, a flexible steel structure can be subjected to a very large number of working cycles with minimal changes in stiffness or brittleness.

Although steel has many desirable qualities for use as a flexible coupling member, steel has numerous shortcomings that limit its desirability and usefulness for certain applications. For example, steel is susceptible to rust and corrosion when exposed to moisture. Rust and corrosion can substantially decrease the aesthetic appeal of the chair and can also diminish the structural integrity of the chair. In another shortcoming, steel has a relatively high density and is therefore heavy and cumbersome as compared with many other materials. As a result, a chair having steel components can be quite difficult to move. In yet another shortcoming, steel has a relatively high heat capacity and can therefore become uncomfortably hot when exposed to direct sunlight.

Due to these and other shortcomings associated with the use of steel, aluminum has become an increasingly popular material for use in outdoor furniture components. Aluminum is lightweight, rust-resistant, and is better suited for use in direct sunlight. However, in the past, attempts to manufacture flexible components from aluminum have not been successful because aluminum does not have the same desirable flexibility and strength of steel. In particular, a flexible coupling member made of aluminum has not been capable of providing the desirable qualities of a steel spring while providing sufficient structural integrity to ensure safe use. Accordingly, attempts to manufacture rocking chairs using flexible coupling members made from aluminum or aluminum alloys have not been met with widespread success.

Thus, there exists a need for a fixed-base chair structure formed, at least in part, from lightweight, rust resistant, aluminum components that is capable of providing a desirably smooth and soft rocking movement. It is desirable that such a chair structure be capable of providing a swivel motion. It is also desirable that such a chair structure include a flexible coupling member that is capable of providing the strength and durability to be used with a wide variety of body weights over a very large number of rocking cycles. Furthermore, such a chair should be configured to minimize undesirable lateral rocking motions. To be practical, such a chair must be easy to transport and inexpensive to manufacture. The present invention addresses these needs.

SUMMARY OF THE INVENTION

The present invention provides a new and improved, rugged, lightweight, outdoor rocking chair that provides a desirably comfortable rocking motion using an improved spring mechanism that is preferably formed from aluminum alloy. The spring mechanism includes at least one C-shaped member (i.e., "C-spring") that provides a flexible coupling member between a fixed base portion and a seat portion. The C-spring is manufactured with a contoured profile that provides desirable strength and flexibility.

In one aspect of the invention, the chair includes at least one C-spring that is strong, lightweight and has a relatively thin profile. The C-spring is preferably formed from an aluminum alloy and therefore will not rust when exposed to sunlight and moisture. In a significant feature of the invention, the C-spring is formed with a contoured profile of variable thickness. The C-spring is preferably contoured to provide a cross-sectional profile having a thin middle portion and thicker side portions. As a result of the contoured profile, the C-spring has excellent structural integrity while providing high torsional stiffness to reduce undesirable lateral movements of the seat portion relative to the base portion. Such a contoured C-spring also provides a lightweight, rugged construction that is capable of withstanding a wide variety of body weights over a large number of working cycles.

In a preferred embodiment, the chair has two aluminum C-springs that are mounted in a spaced-apart configuration. The C-springs are constructed to provide a spring constant that allows the seat portion to be rocked in a forward and backward motion over a desirable range of motion. At the same time, the spacing of the C-springs creates a very stable structure that resists undesirable lateral rocking movement.

In another aspect of the invention, the rocking chair of the present invention is characterized by a seat portion, a fixed base and a pair of spaced-apart aluminum C-springs which flexibly couple the seat portion to the base portion. The C-springs are mounted at opposite ends of a horizontal support. To provide a swivel motion, a vertical post extends downward from the horizontal support. The bottom end portion of the post is received by a center hole in a fixed base. The post is capable of rotating within the hole to provide the swivel motion. The fixed base is configured for contacting the ground to provide a stable support. The fixed base may take a variety of different forms, including, but not limited to, three legs, four legs, or a circular member.

Other features and advantages of the invention will become apparent from the following detailed description, taken in conjunction with the accompanying drawings, which illustrate, by way of example, the features of the invention.

DETAILED DESCRIPTION OF THE PREFERRED EMBODIMENTS

Due to changing weather conditions and the like, outdoor furniture is frequently transported from place to place. Therefore, it is desirable that an outdoor chair be constructed from durable, lightweight materials. Furthermore, to be comfortable and convenient, it is desirable that an outdoor chair provides a comfortable rocking motion. In addition, it is desirable that an outdoor chair possesses sufficient structural integrity such that it can withstand a rocking motion over a large number of working cycles without deforming or breaking. Finally, it is desirable that an outdoor chair be constructed from a material that will not rust due to exposure to sunlight or moisture.

Figure 1:
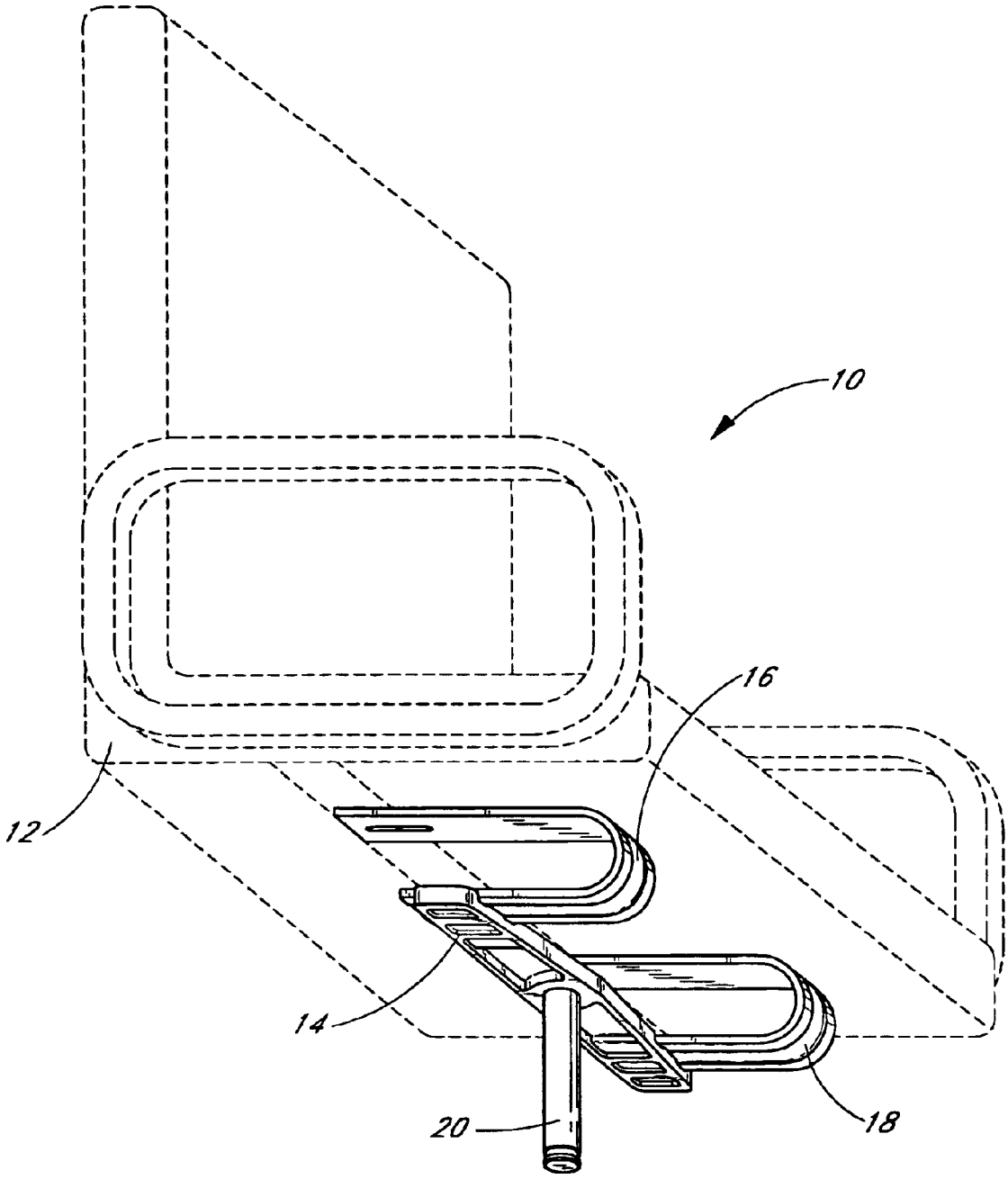
FIG. 1 is a perspective view of a preferred embodiment of a chair structure having a flexible coupling member comprising two spaced-apart C-springs mounted along a horizontal support.

Referring now to FIG. 1, for purposes of illustration, a preferred embodiment of the present invention is embodied in a portable outdoor rocking chair 10 including, generally, a seat portion 12, a horizontal support 14 and two C-springs 16, 18. Each of the C-springs has an open end and a closed end and is manufactured to have a desired stiffness for providing the chair with a smooth rocking motion over a comfortable range of motion. The C-springs are adapted to provide a rugged construction and may be subjected to a large number of bending cycles while maintaining a constant stiffness. By utilizing two spaced-apart C-springs, the chair provides a large resistance against undesirable lateral movement. The C-springs are preferably formed from an aluminum alloy, such as 6061-T4. Alternatively, the C-springs may be formed from other aluminum alloys, or from other suitably strong, yet lightweight materials.

Still referring to FIG. 1, in order to provide a swivel motion, a cylindrical post 20 extends from the bottom of the horizontal support 14 and projects vertically downward. In a significant feature of the present invention, the horizontal support 14 and the post 20 are die cast as a single unit for improved strength and ease of manufacture. The horizontal support and post are preferably made of an aluminum alloy, such as, for example 6063-T5. As illustrated in FIG. 1, the bottom surface of the horizontal support 14 is preferably milled to reduce weight while still leaving sufficient material to maintain excellent strength. The horizontal support 14 is preferably about 12–16 inches in length, and most preferably is about 13.8 inches in length. The horizontal support is preferably about 2.0–3.5 inches in width, and most preferably is about 2.6 inches in width. The horizontal support may be straight or shaped along its longitudinal axis as desired according to the particular need.

Figure 2:
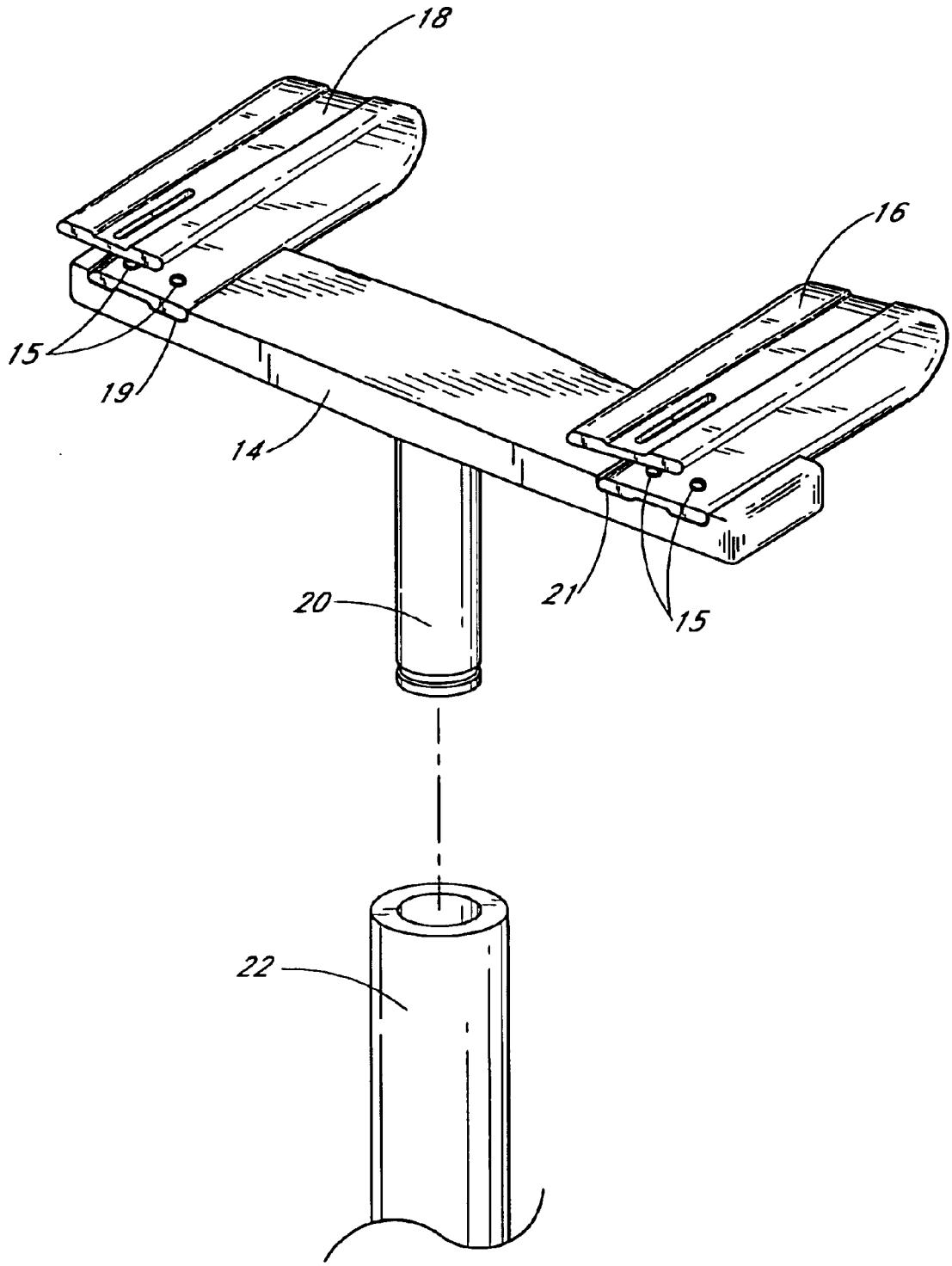
FIG. 2 is an enlarged perspective view of the flexible coupling member of FIG. 1 and further illustrating assembly of the post into a hole formed in the fixed-base of the chair structure.

Referring now to FIG. 2, each of the C-springs 16, 18 is preferably attached to the top surface of the horizontal support 14 by a plurality of bolts 15. However, the C-springs may be attached by other means, such as by welding or brazing, without departing form the scope of the invention. A hollow member 22 is provided in the fixed-base portion of the chair and provides a cylindrical cavity for receiving the bottom end portion of the post 20 in a telescopic fashion. The post 20 is rotatable within the hollow member 22 to allow the seat portion 12 to swivel relative to the fixed-base portion (not shown). Alternatively, a cylindrical cavity may be integrated into the horizontal support and a post may be attached to the fixed-base without departing from the scope of the invention.

As illustrated in FIG. 2, the top surface of the horizontal support 14 preferably includes recesses 19, 21 at the left and right ends wherein the recesses are shaped to receive the contoured surfaces of the C-springs 16, 18. The recesses 19, 21 allow for improved mating of the components and provide enhanced mounting stability and structural integrity. The C-springs are preferably mounted at or near the left and right ends of the horizontal support for maximum lateral support. In a preferred construction, the centerlines of the C-springs are spaced approximately 10 inches apart.

Figure 3:
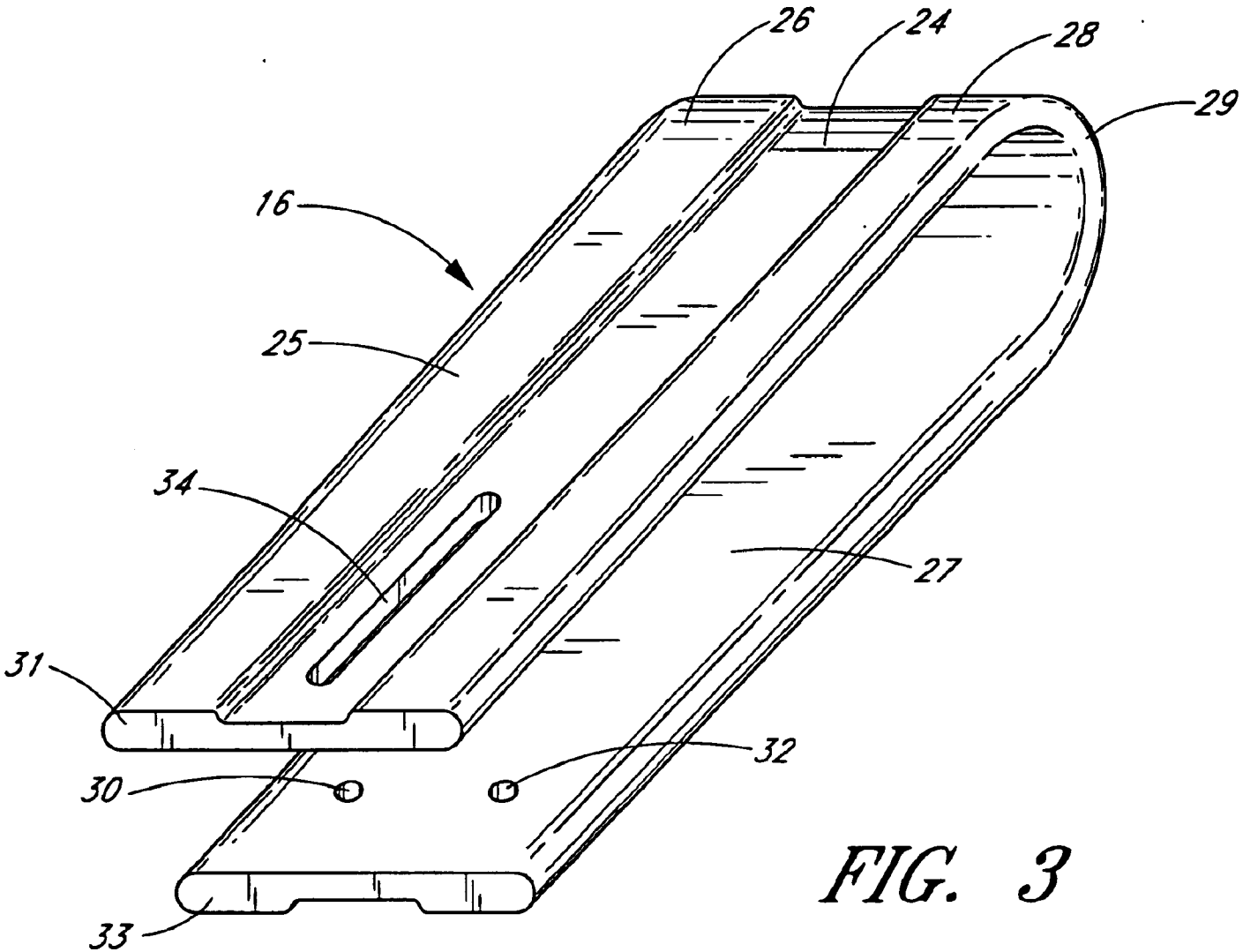
FIG. 3 is an enlarged perspective view of a single C-spring illustrating the contoured frofile and mounting features.

FIG. 3 illustrates an enlarged view of an individual C-spring 16 according to a preferred embodiment of the present invention. The C-spring 16 is a substantially elongate member having a first end 31 and a second end 33. The elongate member is folded over to provide a top segment 25, a bottom segment 27 and a curved segment 29.

In an important feature of the preferred embodiments, the C-spring 16 is manufactured with a relatively thin center portion 24 as compared with the thicker side portions 26, 28, thereby providing a contoured, variable thickness, cross-sectional profile. To provide the thin center portion 24, a channel extends along the outer surface of the C-spring, preferably along the entire length from the first end to the second end. The variable thickness profile advantageously reduces the weight of the spring while achieving excellent strength and flexibility. Furthermore, the unique profile advantageously allows the C-spring to provide a smooth and predictable rocking motion over a wide variety of body weights. Unlike previous spring configurations, the contoured C-spring of the present invention is flexible enough such that a relatively lightweight person can rock comfortably, yet has the strength to also accommodate large body weights. Furthermore, the contoured shape of each C-spring provides a high torsional resistance. In an important feature, the high torsional resistance minimizes undesirable lateral movements of the seat portion relative to the base portion and thereby provides the user with a very comfortable and consistent rocking motion.

Each C-spring is preferably provided with at least two circular holes 30, 32 extending through the bottom segment 27 of the C-spring. Bolts or other fasteners are inserted through the holes to enable attachment of the C-spring to the horizontal support. Each C-spring is further provided with a slot 34 extending through the top segment 25 for facilitating attachment to the bottom of the seat portion of the chair. Attachment to the seat portion can be achieved using bolts, welding, or any other fastener or combination of attachment means.

Preferably, each C-spring is about 2.81 inches wide and is about 0.29 inches thick along the side portions 26, 28. The center portion 24 is preferably about 0.20 inches thick and 1.14 inches wide. The C-spring is preferably about 8.5 inches in length from front to back and is about 2.5 inches in height from top to bottom.

Figure 4:
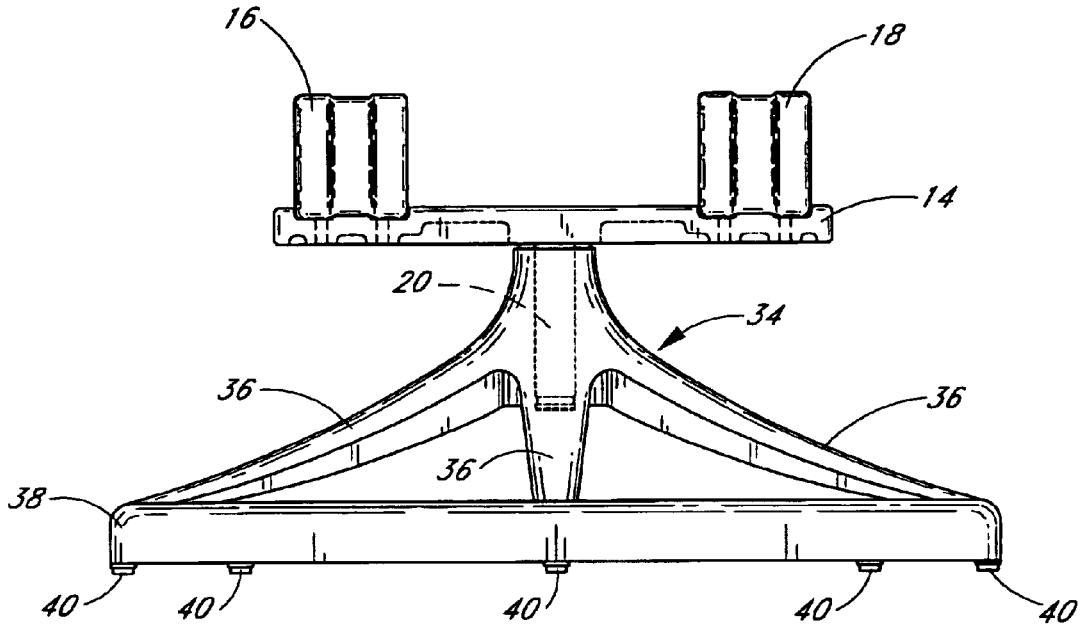
FIG. 4 is a front elevational view of the fixed base portion and the flexible coupling member.

FIG. 4 is a front elevational view of a preferred embodiment showing a fixed-base portion 34 of a chair structure with a flexible coupling member mounted thereon. The post 20 (shown in phantom) is inserted into a cylindrical cavity in the fixed-base portion 34. The fixed-base portion includes a plurality of legs 36 mounted at the bottom end to a circular ring 38. The circular ring 38 is adapted for contact with the ground. A plurality of skid-resistant pads 40 is provided along the bottom surface of the circular ring 38. Although the fixed-base portion is illustrated in a particular form, the fixed-base portion may take a variety of different forms without departing from the scope of the present invention.

Figure 5:
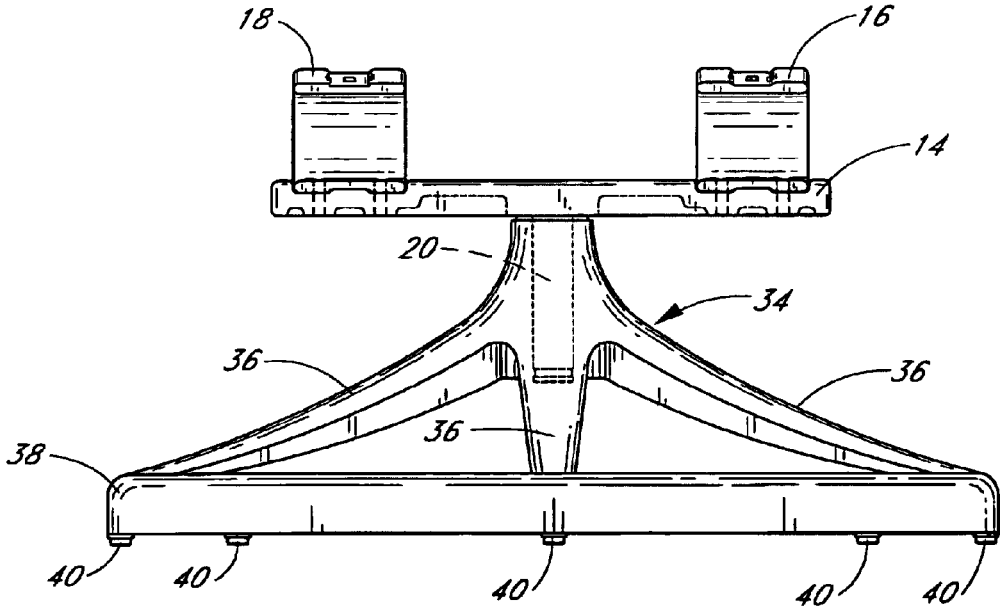
FIG. 5 is a rear elevational view of the structure of FIG. 4.
Figure 6:
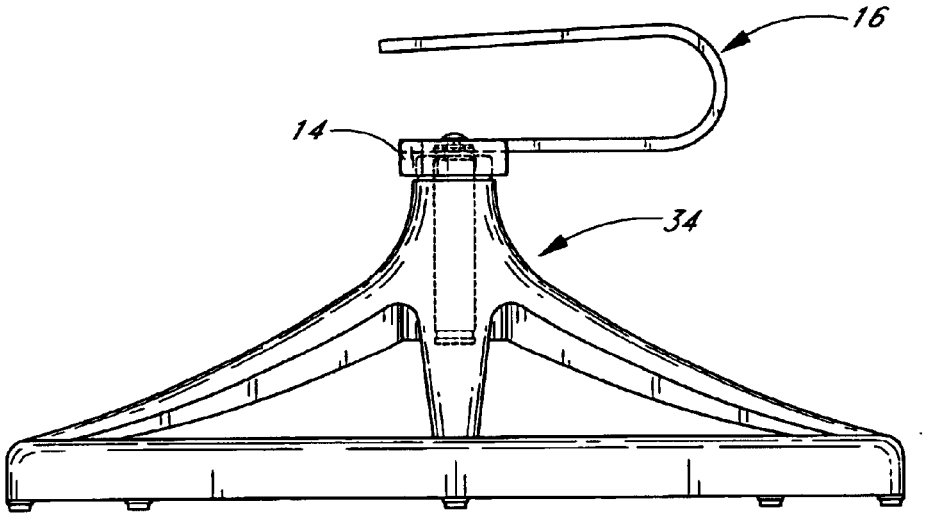
FIG. 6 is a right side elevational view of the structure of FIG. 4.
Figure 7:
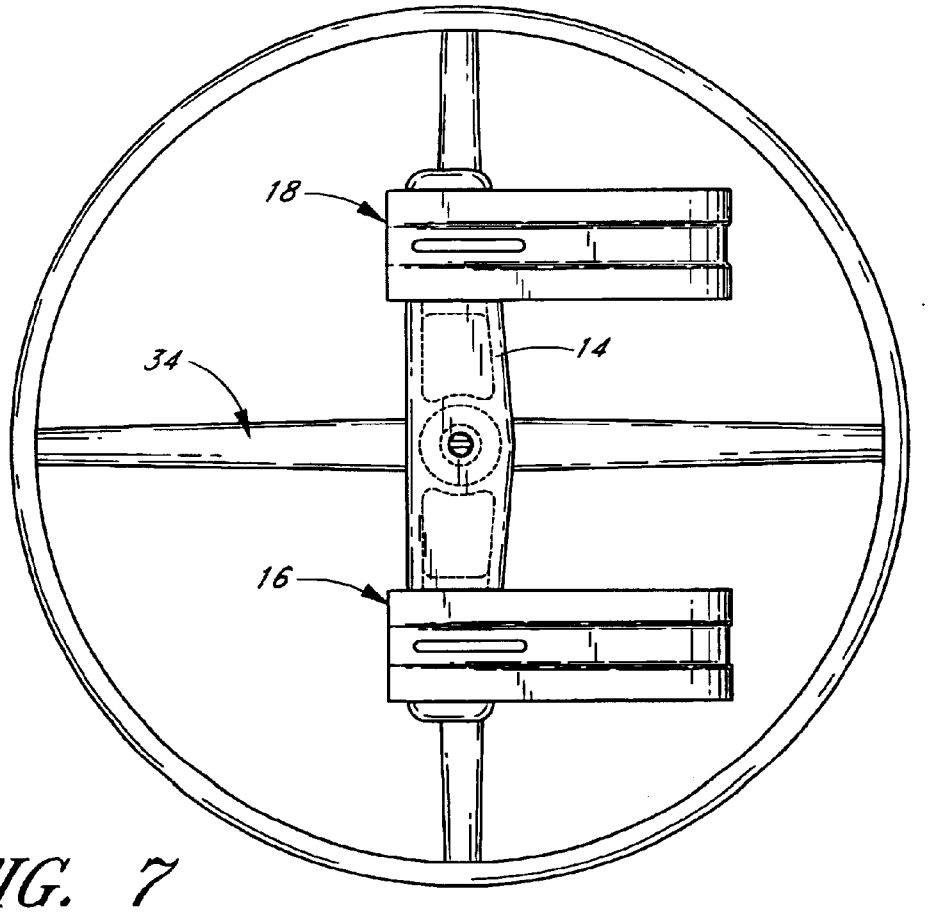
FIG. 7 is a top plan view of the structure of FIG. 4.

As discussed above, the flexible coupling member is constructed to allow the seat portion to swivel or rock back and forth with respect to the fixed-base portion. The flexible coupling member comprises a horizontal support 14 with a vertical post 20 extending downward into the fixed-base structure. The vertical post enters a cylindrical cavity in the fixed-base portion to provide a smooth and easy swivel motion. A pair of spaced-apart C-springs 16, 18 is mounted along the top of the horizontal support 14. A seat portion (not shown) is mounted to the top segments of the C-springs 16, 18. FIGS. 5 through 7 illustrate rear, right side and top views, respectively, of the fixed-base portion having the flexible coupling member of FIG. 4 mounted thereon.

Figure 8:
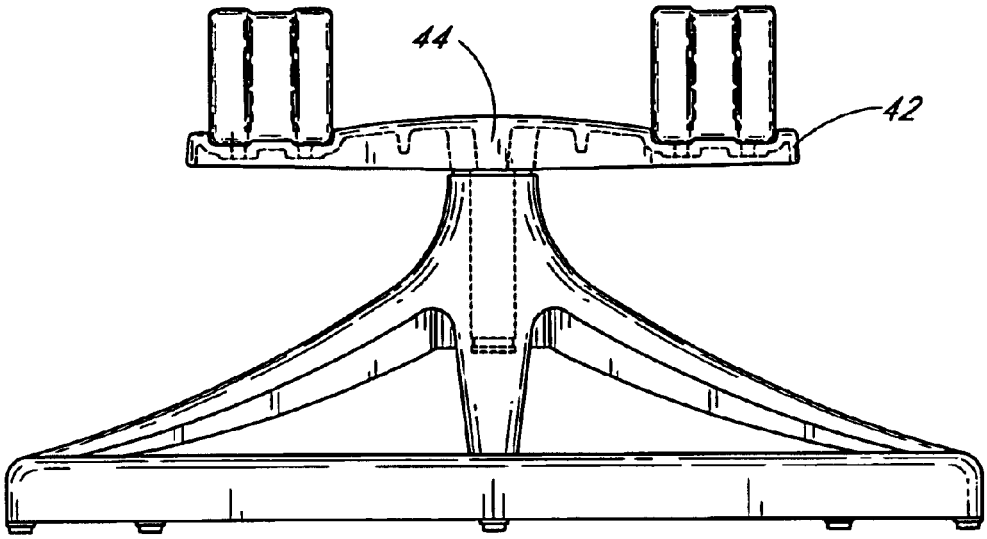
FIG. 8 is a front elevational view of an alternative embodiment of a horizontal support.

FIG. 8 is a front elevational view illustrating an alternative embodiment of a horizontal support 42 having a curved shape that provides a relatively thick center portion 44. FIG. 8 is exemplary of one alternative embodiment of a horizontal support; however, the horizontal support may take a wide variety of different shapes and any support member capable of supporting the C-springs is believed to be within the scope of the present invention.

Figure 9:
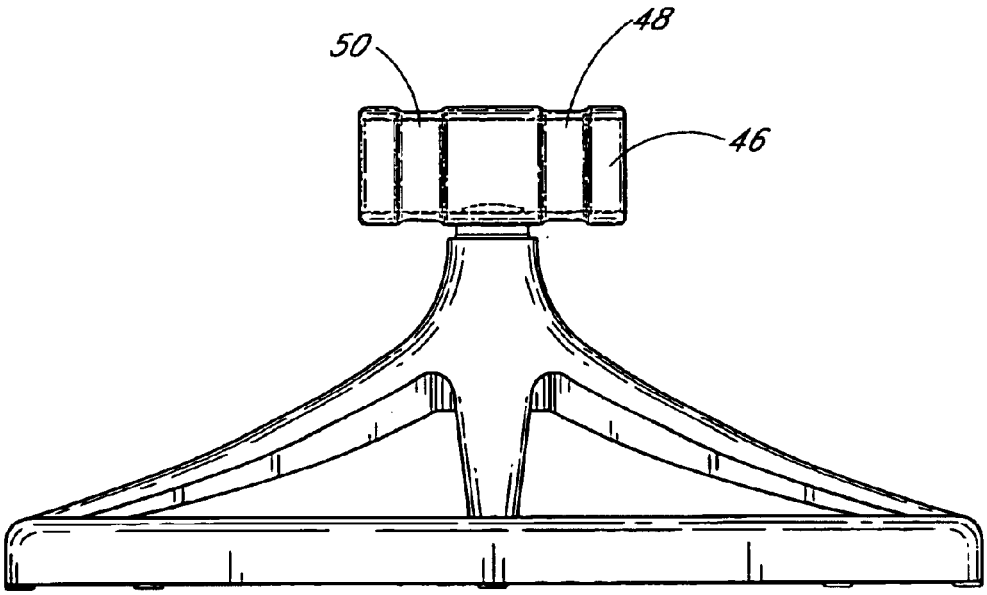
FIG. 9 is a front elevational view of another alternative embodiment of a flexible coupling member having a single contoured C-spring.

FIG. 9 is a front elevational view illustrating another alternative embodiment of a flexible coupling member comprising a single C-spring 46. The single C-spring is relatively wide as compared with the previously shown embodiments. The C-spring also includes a pair of channels 48, 50 that extend longitudinally along the outer surface thereof. In this embodiment, no horizontal support is necessary and the C-spring is coupled directly to the fixed-base portion, preferably by a rotatable coupling mechanism. The C-spring is preferably configured to be wide enough to minimize lateral movements of the seat portion. An embodiment using a single C-spring has fewer parts and is therefore more lightweight and easier to manufacture.

From the foregoing, it will be appreciated that the present invention is lightweight rocker mechanism that provides a smooth and predictable rocking motion over a wide range of body weights. A rocking chair employing the rocker mechanism may be easily transported from place to place and is versatile enough for use in an indoor or outdoor environment. Furthermore, the rocker mechanism is resistant to corrosion, is easy to manufacture and provides excellent strength and durability.

SCOPE OF THE INVENTION

The above presents a description of a preferred embodiment of a flexible coupling mechanism adapted for use with a rocking chair, and of the manner and process of making and using it, in such full, clear, concise and exact terms as to enable any person skilled in the art to which it pertains to make and use this flexible coupling mechanism. This flexible coupling mechanism is, however, susceptible to modifications and alternate construction from that discussed above which are fully equivalent. Consequently, it is not the intention to limit this flexible coupling mechanism to the particular embodiments disclosed. On the contrary, the intention is to cover all modifications and alternate construction coming within the spirit and scope of the flexible coupling mechanism as generally expressed by the following claims, which particularly point out and distinctly claim the subject matter of the flexible coupling mechanism and chair structure using the same.

What is claimed is:

1. A chair for providing swiveling and rocking motions, comprising:

a fixed base portion adapted for resting on a surface, said fixed base portion having a vertical cylindrical cavity formed therein;

a pivot post having a top end and a bottom end, said post being insertable into said cylindrical cavity such that said post is rotatable relative to said fixed base portion;

a horizontal support attached to said top end of said post;

a seat portion; and a flexible coupling joint located between said horizontal support and said seat portion, said flexible coupling joint including a pair of spaced apart C-shaped members wherein a bottom segment of each of said C-shaped members is attached to said horizontal support and a top segment of each of said C-shaped members is attached to said seat portion, and wherein each of said C-shaped members has a contoured cross-sectional profile having a thin center portion and thicker side portions.

2. The chair of claim 1, wherein each of said C-shaped members is made of an aluminum alloy.

3. The chair of claim 1, wherein a top surface of said horizontal support is formed with a pair of recesses shaped to receive said C-shaped members.

4. The chair of claim 1, wherein said contoured cross-sectional profile is formed by a channel extending longitudinally along an outer surface of each of said C-shaped members between a first end and a second end.

5. The chair of claim 1, wherein each of said C-shaped members is a substantially flat, elongated member that is bent to provide said top and bottom segments and a curved segment.

6. The chair of claim 5, wherein said curved segment of each of said C-shaped members is located along a front end of said chair.

7. The chair of claim 1, further comprising a plurality of bolts for attaching said C-shaped members to said horizontal support.

8. The chair of claim 1, wherein said horizontal support is milled along a bottom surface for reducing weight.

9. A chair structure for providing a rocking motion, comprising:

a fixed base portion adapted for resting on a surface;

a horizontal support coupled to a top end of said fixed base portion;

a pair of spaced apart C-shaped members each having a top segment and a bottom segment, said bottom segment being attached to said horizontal support, each of said C-shaped members having a contoured cross-sectional profile formed by a channel extending longitudinally along an outer surface, said channel providing a center portion having a first dimension and a side portion having a second dimension; and a seat portion coupled to said top segment of each of said C-shaped members;

whereby said C-shaped members provide a flexible coupling joint between said seat portion and said horizontal support for providing the rocking motion.

10. The chair structure of claim 9, wherein said fixed-base portion comprises a plurality of legs.

11. The chair structure of claim 9, wherein a top surface of said horizontal support is formed with a pair of recesses shaped to receive said C-shaped members.

12. The chair structure of claim 9, wherein each of said C-shaped members is a substantially flat , elongated member that is bent to provide said top and bottom segments and a curved segment.

13. The chair structure of claim 12, wherein each of said curved segments is located along a front end of said chair.

14. The chair structure of claim 9, further comprising a plurality of bolts for attaching said C-shaped members to said horizontal support.

15. A chair structure for providing a rocking motion, comprising:

a fixed base portion adapted for resting on a surface;

a horizontal support coupled to a top end of said fixed base portion;

a pair of spaced apart C-shaped members, each of said C-shaped members being made of an aluminum alloy and having a top segment and a bottom segment, said bottom segment being attached to said horizontal support, each of said C-shaped members being formed with a contoured cross-sectional profile having a center portion with a first dimension and a side portion with a second dimension; and a seat portion coupled to said top segment of each of said C-shaped members;

whereby said C-shaped members provide a flexible coupling joint between said seat portion and said horizontal support for providing the rocking motion.

16. The chair structure of claim 15, wherein said fixed-base portion comprises a plurality of legs.

17. The chair structure of claim 15, wherein a top surface of said horizontal support is formed with a pair of recesses shaped to receive said C-shaped members.

18. The chair structure of claim 15, wherein each of said C-shaped members is a substantially flat, elongated member that is bent to provide said top and bottom segments and a curved segment.

19. The chair structure of claim 18, wherein each of said curved segments is located along a front end of said chair.

20. The chair structure of claim 15, further comprising a plurality of bolts for attaching said C-shaped members to said horizontal support.

21. A chair structure for providing a rocking motion, comprising:

a fixed base portion adapted for resting on a surface;

a horizontal support coupled to a top end of said fixed base portion;

a pair of spaced apart C-shaped members each having a top segment and a bottom segment, said bottom segment being attached to said horizontal support, each of said C-shaped members being formed with a contoured cross-sectional profile having a center portion with a first dimension and a side portion with a second dimension, said first dimension being less than said second dimension; and a seat portion coupled to said top segment of each of said C-shaped members;

whereby said C-shaped members provide a flexible coupling joint between said seat portion and said horizontal support for providing the rocking motion.

22. The chair structure of claim 21, wherein said fixed-base portion comprises a plurality of legs.

23. The chair structure of claim 21, wherein a top surface of said horizontal support is formed with a pair of recesses shaped to receive said C-shaped members.

24. The chair structure of claim 21, wherein each of said C-shaped members is a substantially flat, elongated member that is bent to provide said top and bottom segments and a curved segment.

25. The chair structure of claim 24, wherein each of said curved segments is located along a front end of said chair.

26. The chair structure of claim 21, further comprising a plurality of bolts for attaching said C-shaped members to said horizontal support.

* * * * *